United States Patent [19]

Bickford et al.

[11] Patent Number: 4,458,563

[45] Date of Patent: Jul. 10, 1984

[54] TORQUE WRENCHES

[75] Inventors: John H. Bickford, Middletown; Robert F. Snyder, Hamden, both of Conn.

[73] Assignee: Raymond Engineering Inc., Middletown, Conn.

[21] Appl. No.: 344,602

[22] Filed: Feb. 1, 1982

[51] Int. Cl.[3] ..... B25B 13/46

[52] U.S. Cl. ..... 81/57.39; 74/128

[58] Field of Search ..... 81/57.39, 57.29, 57.3; 74/128

[56] References Cited

U.S. PATENT DOCUMENTS

| | | | |
|---|---|---|---|
| 2,758,569 | 8/1956 | Peterson | 74/128 |
| 3,987,691 | 10/1976 | Savage | 81/57.3 |
| 3,987,692 | 10/1976 | Lesner et al. | 81/57.29 |
| 4,233,865 | 11/1980 | Junkers | 81/57.39 |
| 4,287,795 | 9/1981 | Curtis | 81/57.3 |
| 4,336,727 | 6/1982 | Junkers | 74/128 |

FOREIGN PATENT DOCUMENTS

| | | | |
|---|---|---|---|
| 671630 | 9/1929 | France | 81/61 |

*Primary Examiner*—James L. Jones, Jr.
*Attorney, Agent, or Firm*—Fishman & Dionne

[57] ABSTRACT

A torque producing tool of compact design may have its driven output member displaced from the tool body through use of an easily attachable extension drive. By providing a plurality of different extension drives the maximum output torque of the tool may be varied in stepwise fashion.

15 Claims, 9 Drawing Figures

TORQUE WRENCHES

BACKGROUND OF THE INVENTION

1. Field of the Invention

The present invention relates to enhancement of the utility of fluidically actuated wrenches and particularly to enabling the maximum torque produced by such wrenches to be varied in stepwise fashion and/or to be displaced from the body of the tool to thereby enable the tightening of fasteners which would otherwise be inaccessible. More specifically, this invention is directed to improvements in fluidically operated tools and especially to the reduction in the size and weight of such tools and to the provision of the capabilities of varying the output torque provided by such tools and displacing the output member from the tool body. Accordingly, the general objects of the present invention are to provide novel and improved methods and apparatus of such character.

2. Description of the Prior Art

The present invention relates to that type of fluidically powered tool which has become known in the art as a "torque wrench". An example of such a prior art "torque wrench" may be seen from U.S. Pat. No. 3,745,858. The tool of U.S. Pat. No. 3,745,858 provides an output torque via a rotatable socket which is driven during each forward stroke of the piston in a hydraulic cylinder. The tool includes a lever arm which drives the socket in a first direction, the socket being mounted in a frame, and a ratchet mechanism which permits movement of the piston in the opposite direction, without applying a reverse torque to the socket, upon completion of each torque producing stroke. The piston rod extending from the power producing hydraulic cylinder is coupled to the rotatable socket by means of the lever arm and the hydraulic piston subassembly is pivotally coupled to the frame and to the lever arm. The frame of the tool will be coupled to a rigid member in order to provide a platform which may be reacted against.

Tools of the type depicted in U.S. Pat. No. 3,745,858 have had significant commercial success. However, prior art fluidically operated "torque wrenches" have a number of inherent characteristics which have served to limit the utility of these tools. Most significantly, the prior tools have been somewhat inconvenient to use due to their weight, size and shape. Many bolts which would desirably be tightened using a power operated wrench are located in pockets or under projections and thus could previously be reached only with a tool in the form of a comparatively thin lever. Interestingly, although "torque wrenches" have been available for many years, the typical machine designer continues to assume that all bolts will be tightened with a lever regardless of the size of the bolt or the magnitude of the torque which must be applied thereto to achieve the requisite tightening. As will be apparent from perusal of U.S. Pat. No. 3,745,858, it is simply impossible to engage a socket which is directly driven by patented tool with a bolt located under a projection or in some other similarly inaccessible location.

It is to be noted that there have been attempts in the prior art to address the problem of coupling a "torque wrench" to an inaccessible nut or bolt head. Thus, for example, it has been suggested to employ a torque link, sometimes referred to in the art as a "crowfoot", to couple the tool to the fastener. A "crowfoot" is merely an elongated member which will be mechanically fastened at one end to the wrench output socket and which will be provided, adjacent its other end, with a socket-shaped opening. While the use of a "crowfoot" is an inexpensive approach, it does not offer a satisfactory solution to the problem since the torque applied to the fastener can be somewhat greater than the output of the wrench and will vary with the angle between the "crowfoot" and the wrench. In most cases where a "torque wrench" is employed it is necessary that the fastener be tightened to a predetermined degree and thus the torque applied to the fastener must be known and controlled.

Another proposed approach to solving the problem of tightening difficult to reach fasteners, which has to date been employed only on mechanical wrenches of the type disclosed in U.S. Pat. No. 3,683,686, is to provide an extension comprising a series of gears mounted within a housing. While such a gear-type extension drive can be narrower than the wrench itself, and thus able to reach fasteners that the wrench could not reach directly, it is a comparatively expensive accessory which is heavy and thus difficult to use.

A further deficiency of prior art fluidically operated wrenches resides in their lack of flexibility. Thus, it has long been desired to provide a tool which can, as necessary or desirable, react "straight back" of the fastener or at various angles thereto without requiring special reaction adaptors of various size and shape. Similarly, there has been a long standing desire for the ability to change the maximum output torque capability of tools of the type being discussed. In the case of prior art hydraulic wrenches, a different tool was required for each application. This often resulted in the user purchasing a tool which was too big for many of the intended applications.

An additional deficiency of prior art hydraulic "torque wrenches", which was alluded to above in the discussion of U.S. Pat. No. 3,745,858, resides in the comparatively large size and awkward shape of the tool which has resulted from the utilization of a hydraulic actuator pivotally connected to and extended from a frame in which the output socket was rotatably mounted. Thus, there has been a further long standing desire in the art, predicated on the desire to enhance the utility of fluidically operated "torque wrenches", to make such tools more compact and to enhance their torsional rigidity. Also, especially in those cases where the tool is to be used to tighten difficult to reach fasteners, it is desired to have a tool to which attachments, such as extension drives, can easily be coupled. It would also be desirable to provide a tool wherein the hoses which deliver the pressurized operating fluid will be coupled to the same end of the body of the tool and thus less apt to impede use of the tool. In fact, for some applications, the use of a single hose coupled to the tool would be a highly desirable attribute. Present tools employ a pair of fluid supply hoses which are coupled to opposite ends of the actuator cylinder.

SUMMARY OF THE INVENTION

The present invention overcomes the above-briefly discussed and other deficiencies and disadvantages of the prior art by providing a novel and improved fluidically operated wrench characterized by compactness, torsional rigidity, ease of addition of attachments, the ability to vary maximum output torque easily and in stepwise fashion and comparatively light weight. Apparatus in accordance with the preferred embodiment of the present invention also includes, as a removable accessory, an extension whereby the output member of the tool may be displaced from the tool body in any one of a plurality of directions.

Also in accordance with a preferred embodiment, the tool of the present invention is characterized by a body which simultaneously functions as the cylinder for the fluidic actuator and as the support for the rotatable output member. Thus, in counterdistinction to the prior art, a rigidized tool is provided wherein the fluidic actuator is not pivotally supported on and extends from the tool frame. In the tools of the present invention the distance between the end of the actuator piston rod and the axis of rotation of the output member is comparatively short and the actuator is characterized by a comparatively short stroke. Also in accordance with a preferred embodiment of the present invention, the actuator piston rod drives, but is not mechanically connected to, a pawl which, in turn, engages and drives a gear having the tool output socket mounted therein. The pawl is supported so as to be rotatable about an axis which, in turn, is capable of displacement in response to movement of the actuator piston rod. This distance between the axis of rotation of the pawl and that of the gear which it drives thus determines the effective length of the tool "lever arm".

In accordance with one embodiment of the invention, the tool actuator may be hydraulically driven in both directions. In one alternative the actuator piston may be driven hydraulically in the torque producing direction and returned to its initial position pneumatically. In yet a further embodiment, the actuator piston will be returned to its initial position by means of a spring.

The extension drive of a tool in accordance with the present invention may be attached to the tool body, so as to be driven by the gear which carries the tool output socket, quickly and securely. The extension drive will, in one embodiment, be provided with a shoulder which abuts a surface on the tool body whereby relative rotation between the tool body and the body of the extension drive will be precluded. The extension drive will have an output member which, like the tool output member, is in the form of a rotatable gear with a square hole to drive a socket or a hexagonal hole to directly drive a nut or bolt head.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGURES and in which.

DESCRIPTION OF THE PREFERRED EMBODIMENTS

Figure 1:
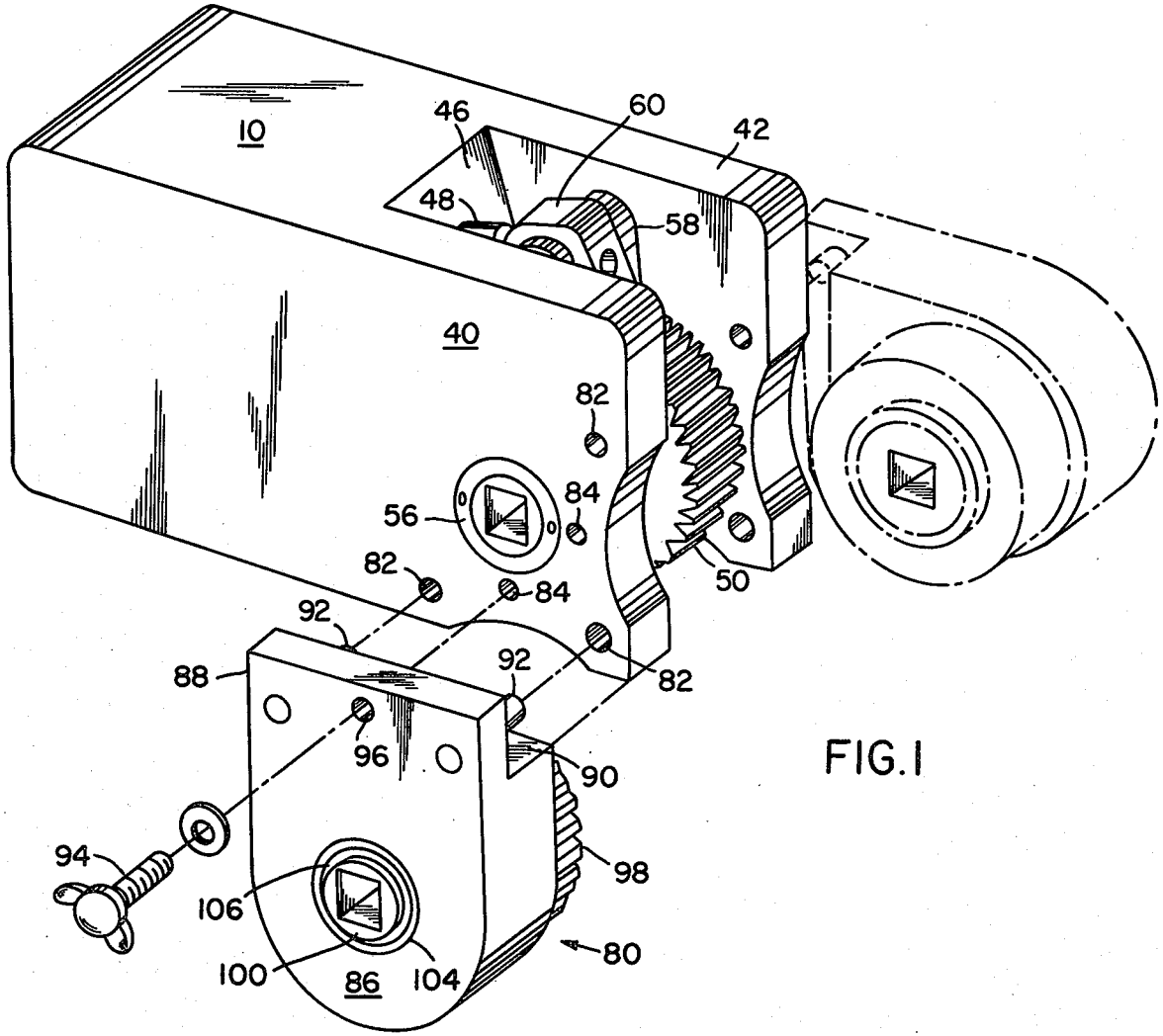
FIG. 1 is a perspective view of a tool and extension drive in accordance with a first embodiment of the present invention.
Figure 2:
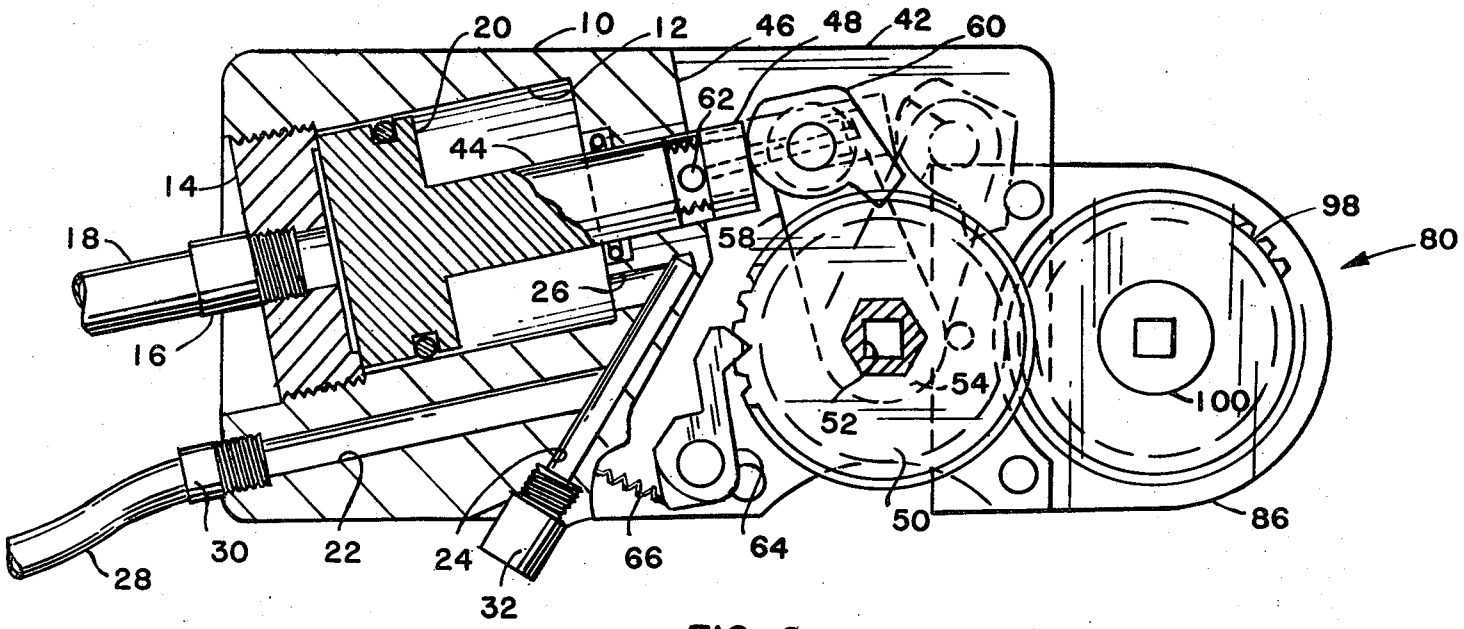
FIG. 2 is a cross-sectional, side elevation view of the tool and extension drive of FIG. 1, the extension being shown in FIG. 2 in the orientation shown in phantom in FIG. 1.
Figure 3:
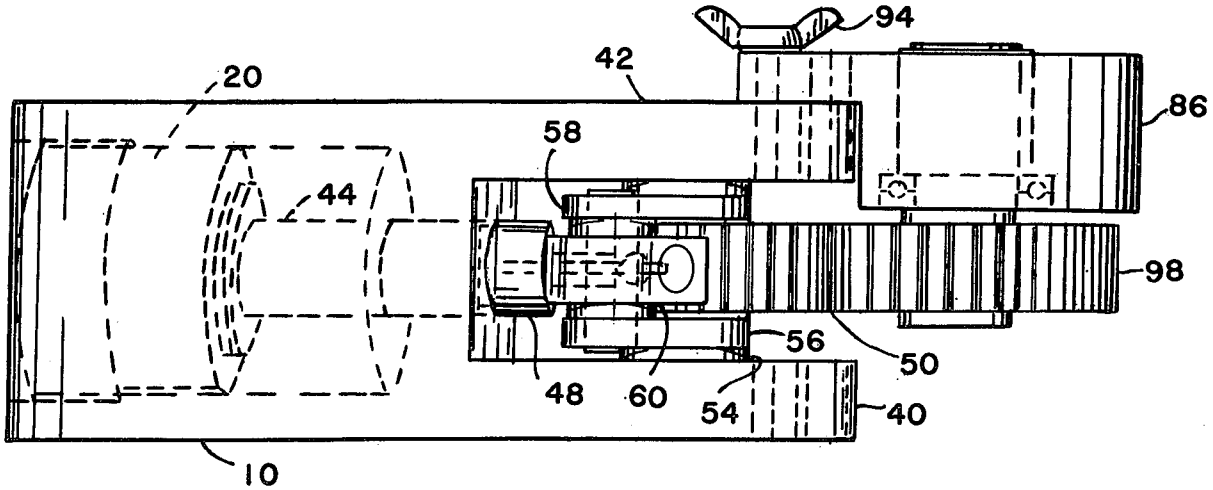
FIG. 3 is a top view of the tool and extension drive of FIG. 2 with the actuator depicted in phantom and the operating fluid supply hoses disconnnected.
Figure 4:
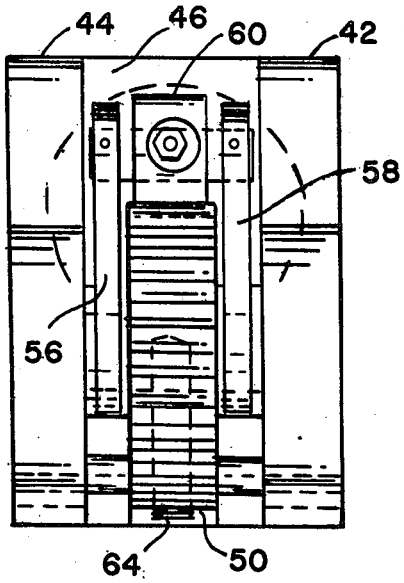
FIG. 4 is a front elevation view taken from the right side of the tool of FIGS. 1 and 2 with the extension drive removed.
Figure 6:
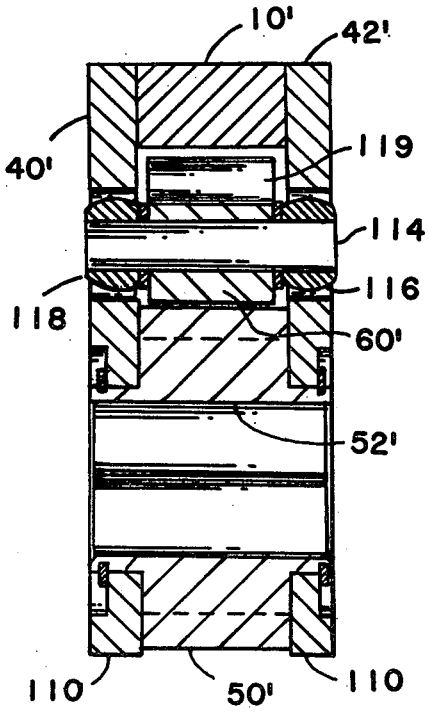
FIG. 6 is a cross-sectional front elevation view of the tool of FIG. 5 taken along line 6—6 of FIG. 5.
Figure 5:
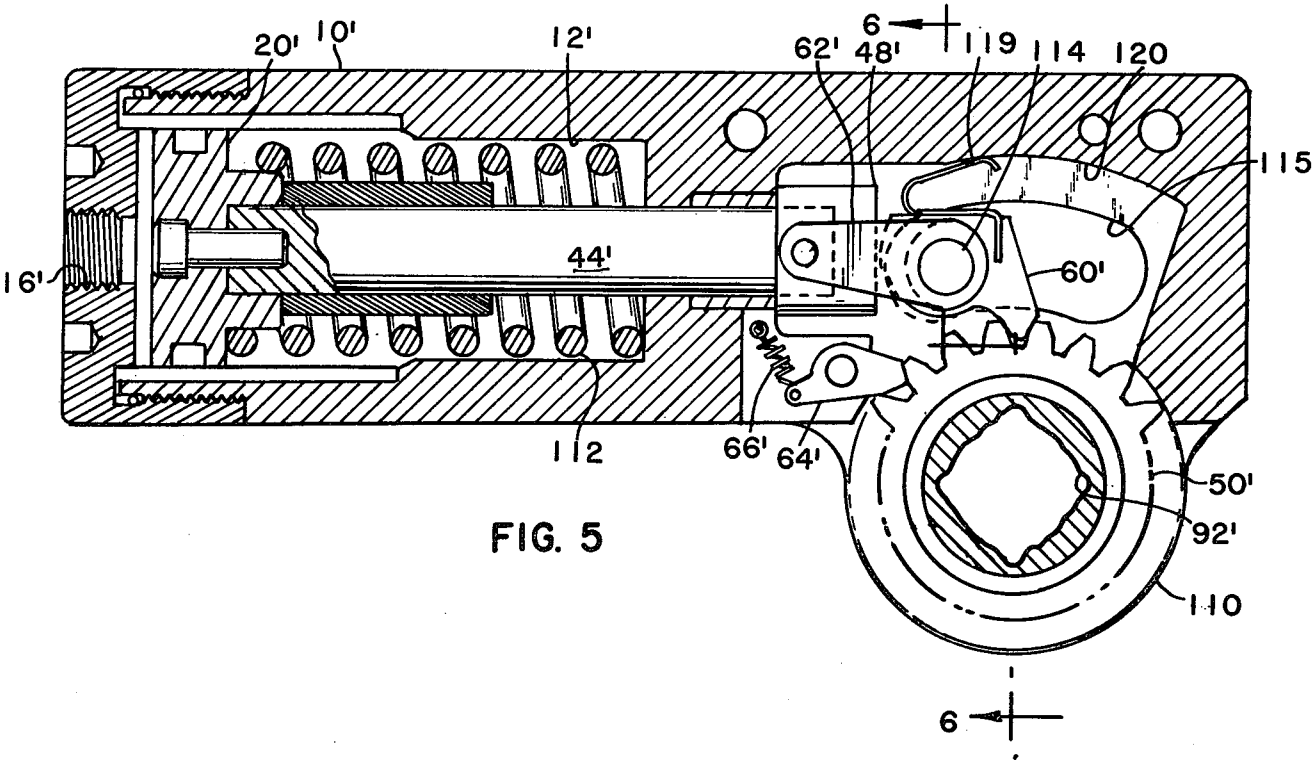
FIG. 5 is a cross-sectional, side elevation view of a tool in accordance with a second embodiment of the present invention.

With reference now to the drawing, and particularly simultaneously to FIGS. 1-4, a hydraulically actuated wrench in accordance with the present invention comprises a housing 10. Housing 10 is bored out, from the end which will form the rear side of the tool, to form a cylinder 12 which may best be seen from FIG. 2. The cylinder 12 is closed by a threaded cap 14 which is provided with a hose fitting 16 to which a supply hose 18 may be connected. The pressurized hydraulic fluid which drives the piston 20 in cylinder 12 in the forward direction is supplied via hose 18, fitting 16 and an aperture in cap 14. The housing 10 is further drilled to define passages 22, 24 and 26 whereby fluid may be delivered to or released from the second or forwardly disposed end of cylinder 12. In accordance with a preferred embodiment, a second supply hose 28 is coupled to passage 22 via a hose fitting 30 and pressurized fluid will be delivered to cylinder 12 via passages 22, 24 and 26 to return piston 20 to the position shown. Depending on the nature and manner of use of the tool, the return stroke of the piston may be pneumatically or hydraulically produced. It should be noted that the hose 28 will be coupled either to the end of passage 22 or to the end of passage 24 and thus, in actual use of a tool in accordance with the embodiment of FIGS. 1-4, only two hoses will be present. In most cases the fitting at the end of passage 24 will receive a plug 32.

The forward end of housing 10 is machined to provide a pair of side plates 40 and 42, which define a space therebetween, and an end wa 46. The piston rod 44 of piston 20 extends through wall 46, which also defines the end of cylinder 12, and into the space between plates 40 and 42. Piston rod 44 is provided, at its end, with a cam driver insert 48 which is typically fabricated from a steel having appropriate wear characteristics including a smooth finish and a hard surface.

An output member 50 in the form of a gear having a square hole 52, which will engage a square bar to drive a socket, in the central, i.e., axial, region thereof is mounted between plates 40 and 42 for rotation by means of an axle 54. Axle 54, which will form part of output member 50, will be supported for rotation on bearings and the square hole 52 will extend all the way through the axle 54 so as to present a rotatable drive in each of plates 40 and 42. The output member 50 may be a gear provided with a hexagonal through-hole on its axis. The axle 54 will have a portion of hexagonal shape and enlarged cross-sectional area intermediate its ends. This hexagonal portion of axle 54 will be complimentary in size and shape to the through-hole in th gear whereby the axle may be inserted through one of the housing side plates and into driving engagement with the gear. The square hole 52 is formed in axle 54. The cylindrical end portions of axle 54 are supported on bearings, such as bearing 56, which may threadably engage the holes provided in plates 40 and 42 for axle 54. As shown in FIG. 1, the bearings may be provided with a pair of spaced holes for engagement by a spanner wrench. The output member 50 and axle 55 thus rotate as a unit in the bearings.

Disposed to either side of output member 50, and also located between plates 40 and 42, are a pair of parallel lever arms 56 and 58 which extend generally radially with respect to the axis of rotation of member 50. Lever arms 56 and 58 are mounted for rotation about the cylindrical end portions of axle 54 to either side of the hexagonal gear engaging portion. A pawl 60 is pivotally supported between lever arms 56 and 58. Pawl 60 is provided with an arcuate reaction surface which is contacted by the insert 48 at the end of piston rod 44. The extension of the axis of the piston rod 44 intersects the radial plane defined by the parallel axes of rotation of output member 50 and pawl 60 at a point displaced inwardly toward output member 50 from the axis of rotation of pawl 60. Pawl 60 engages, as clearly shown in FIGS. 2–4, the peripheral gear teeth in output member 50. Accordingly, during the forward stoke of piston 20, i.e., the power stroke, the pawl 60 will be moved from the initial position shown in solid lines to the position shown in broken lines in FIG. 2 and, during this movement, will impart rotation to output member 50.

During the return stroke of piston 20 the pawl 60 and its associated lever arms will be returned to their initial position. For this purpose, a linkage 62 engages both the piston rod 44 and the pawl as shown. During the return stroke of piston 20 the output member 50 will be prevented from rotation by a second pawl 64 which engages the drive gear portion of output member 50 as shown. Pawl 64 is resiliently biased, by means of a spring 66, into engagement with the gear teeth on output member 50.

The tool described above drives the output member 50 in the clockwise direction. Pressurized fluid delivered to the interior of cylinder 12 at the forward end thereof will function only to return the piston to the initial position where it is shown in solid lines in FIG. 2.

The tool of the present invention is designed for use with, and ease of attachment thereto, an extension drive. Such an extension drive is indicated generally at 80 and it is to be noted that the extension drive may be mounted on the tool of FIGS. 1–4 in four different positions. To this end the side plates 40 and 42 of housing 10 are each provided with three mounting holes 82 which are positioned on pairs of perpendicular lines parallel to a pair of adjoining edges of the plates as shown. Further, each of the side plates is provided with a pair of threaded holes 84. The aforesaid adjoining edges of the side plates are also provided with arcuate cut-outs as shown, there being a flat wall portion extending outwardly from both ends of each of these cut-outs. The extension drive 80 includes a body portion 86 which is provided with an extension 88 which defines a flat shoulder 90. A pair of locating and mounting pins 92 are press fit into the extension 88 of body 86 and extend outwardly therefrom in a direction parallel to the plane of the surface of shoulder 90 for a distance substantially equal to the width of shoulder 90. Engagement of pins 92 with holes 82, the pins having a diameter commensurate with that of the holes, will result in contact being established between flat portions of the tool body, located to either side of an arcuate cut-out, with the shoulder 90 of extension drive body 86. The extension drive may then be locked into position on the tool by means of a bolt 94 which extends through a hole 96 in extension 88 of body 86 and engages one of the threaded holes 84 in a side plate of the tool housing.

The extension drive 80 is, like the basic tool, provided with an output member 98 in the form of a gear mounted for rotation with an axle 100. Axle 100 will typically have an opening, in the form of a square hole 102, extending therethrough. However, the extension drive could also have a hexagonal or other shaped hole therethrough for direct engagement with a fastener. The output member 98 is mounted in body 86 on a bearing 104 and is captured by means of a snap ring 106 which engages a cylindrical portion of axle 100.

Figure 9:
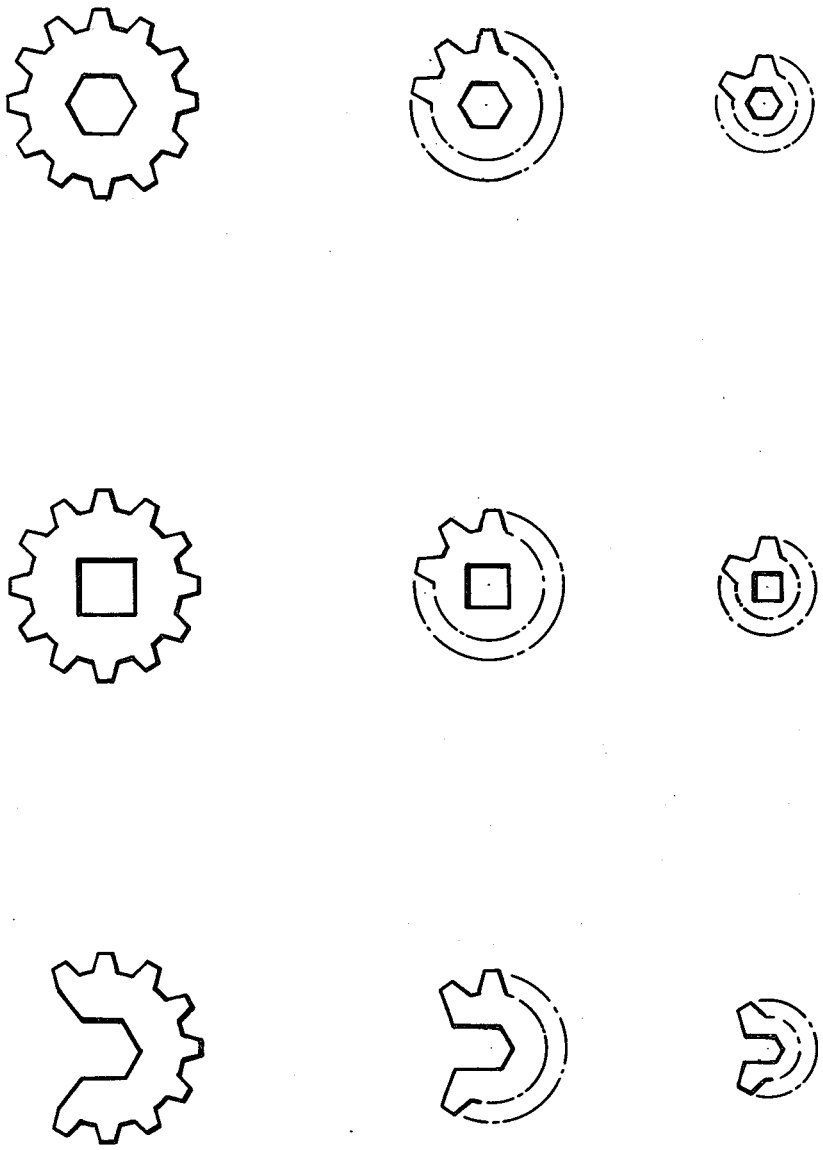
FIG. 9 depicts schematically various types of output devices which may be incorporated in the extension drives of the tools of the present invention.

When installing extension drive 80 on the tool the output member 98 of the extension will pass through an arcuate cut-out in a side plate of the tool housing and into driving engagement with the peripheral teeth on the tool output member 50. There will, in the disclosed embodiment, be a reversal in the direction of drive. That is, if output member 50 of the tool rotates in the clockwise direction, the output member 98 of the drive extension will rotate in the counterclockwise direction. The extension drive 80 is considerably narrower than the tool itself and thus will fit into many places where the tool itself could not be employed. Further, and quite significantly, the maximum output torque of the tool may be quickly and easily changed simply by substituting one comparatively inexpensive extension drive for another since the output torque produced by the basic tool will be magnified or diminished as a function of the relative diameters of the output members 50 and 98. FIG. 9 depicts some of the various fastener engaging members which may be either employed in the extension drive shown in FIGS. 1 and 2 or coupled thereto by means of a square bar. It is particularly noteworthy that the present invention offers the possibility of obtaining any desired output torque from any size tool and the weight of the tool is substantially reduced by reducing the length of movement of the piston which, when compared to tools of the type shown in above mentioned U.S. Pat. No. 3,745,858, has a considerably larger diameter but operates with a much shorter stroke. In summary, the operating characteristics of the tool may be easily changed through changing the easily removable extension drive.

It is to be noted that it is also possible to increase the displacement of the output member of the extension drive from the output member 50 of the tool by incorporating a series, i.e., a drive train, of gears in the extension drive. By the same token, use of an intermediate idler gear between the output member 50 of the tool and the output member of the extension drive will cause the member which engages the fastener being worked to rotate in the same direction as the output member of the base tool.

Referring now to FIGS. 5–8, a second embodiment of a wrench in accordance with the present invention is shown. The tool of FIGS. 5–8 differs from that of FIGS. 1–4 in several respects. Firstly, the integral actuator cylinder 12' has its axis transverse to the end of the tool housing 10' whereas the cylinder in the embodiment of FIGS. 1–4 was drilled at an angle. The arrangement of FIGS. 5–8 results in the dimensions of the tool body being minimized and the output member 50' being mounted in bosses 110 which extend outwardly from the tool body as shown, the bosses 110 being part of a pair of removable side plates 40' and 42'. A further, and very important distinction from the standpoint of convenience of use is that the tool of FIG. 5 employs a spring 112 to return the piston 20' to its initial position during the retract stroke portion of the operating cycle. This enables the tool to be operated with only a single hose extending therefrom, the hose being coupled to the base of housing 10' by means of a fitting which is installed in a threaded hole 16'.

A further difference between the embodiment of FIGS. 5–8 and that of FIGS. 1–4 resides in the fact that in the FIGS. 5–8 embodiment the lever arms which connect the pawl 60' to the output member have been eliminated. Thus, in the embodiment of FIG. 5 the pawl 60' is rotatably mounted on a pivot shaft 114 which travels along a pair of arcuate slots 115 in the side plates 40' and 42' of housing 10' on roller bearings 116 and 118. Thus, as the insert or head 48' on piston rod 44' pushes on pawl 60', the pawl will move in an arcuate path and thus drive the output member 50'. The pawl 60' will be coupled, for retraction, to piston rod 44' by a linkage 62'. A spring 119, which slides on a shoulder 120 provided in housing 10', engages pawl 60' and urges the pawl downwardly into engagement with the peripheral gear teeth on output member 50'.

Figure 7:
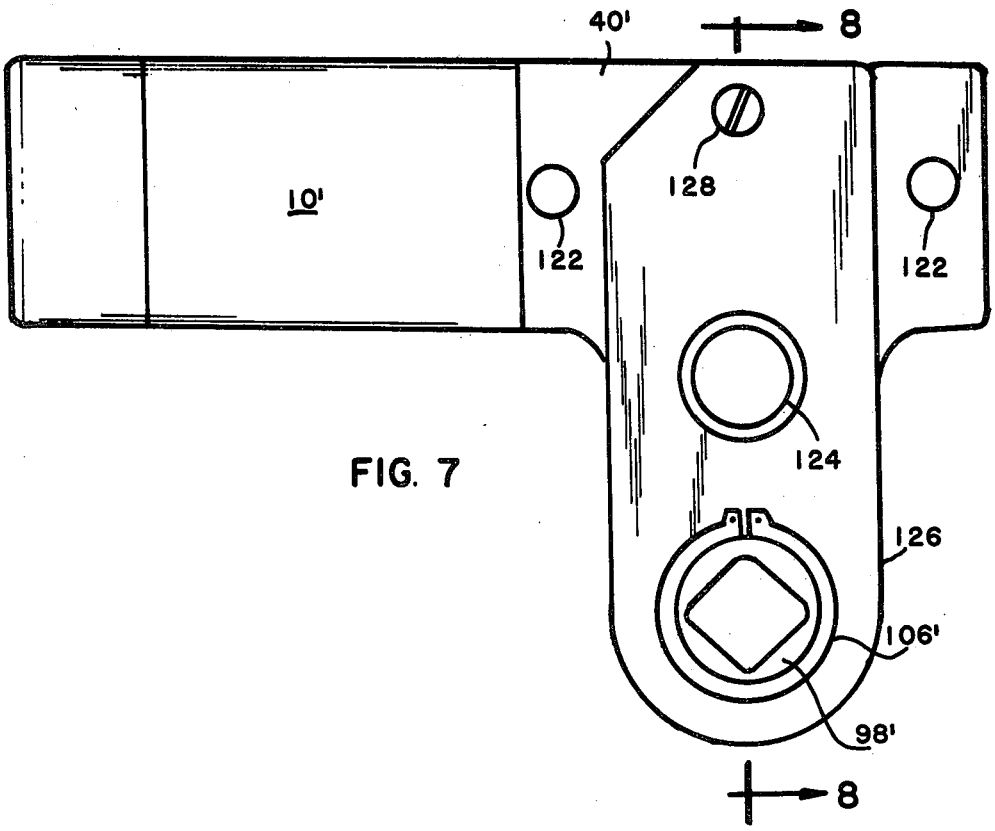
FIG. 7 is a side elevation view of the tool of FIGS. 5 and 6 with an extension drive attached thereto.

In order to permit the mounting of an extension drive on the embodiment of FIGS. 5–8 as may best be seen from FIG. 7, the tool housing is provided on one or both sides with a series of round holes 122, which may be threaded, spaced along an arc. Also, the through-hole 52' in output member 50' is scalloped as shown whereby a round rod 124 (see FIG. 8) may be inserted in and snugly seated in hole 52'.

Figure 8:
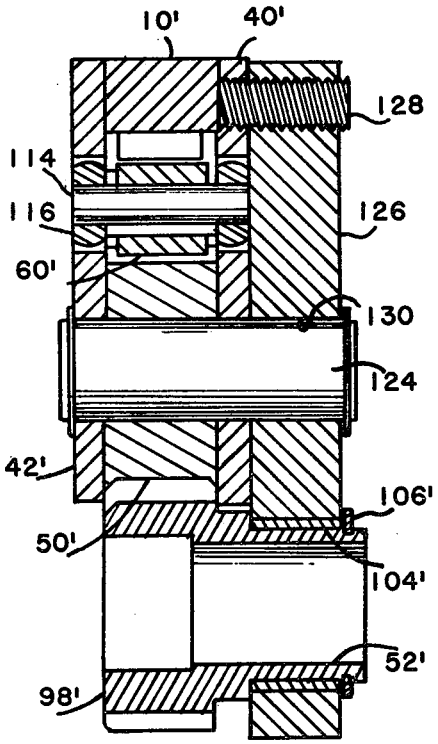
FIG. 8 is a cross-sectional view taken along line 8—8 of FIG. 7.

The extension drive of the embodiment of FIGS. 5–8, as shown in FIGS. 7 and 8, comprises a flat plate 126 on which an output member 98' is mounted in the same manner as described above in the discussion of the embodiment of FIGS. 1–4. A threaded rod 128 is mounted in plate 126 and extends outwardly therefrom for engagement with a selected one of holes 122 in the tool body. After engagement of rod 128 with one of holes 122, a further hole 130 in plate 126 is aligned with square hole 52' in tool output member 50', the round rod 124 is locked in position by means of a pair of snap rings.

It is to be noted that the spring 112 of the embodiment of FIGS. 5–8 may be eliminated and a second fluid connection be made to the forward end of the cylinder 12' so that the retract stroke of the piston may be pneumatically or hydraulically powered.

While preferred embodiments have been shown and described, various modifications may be made thereto without departing from the spirit and scope of the invention. Accordingly, it is to be understood that the present invention has been described by way of illustration and not limitation.

What is claimed is:

1. Apparatus for generating torque comprising:

housing means;

output providing means, said output providing means being supported for rotation on said housing means, said output providing means having gear teeth about its periphery and having a hole of other than circular shape in at least one end thereof, said hole being coaxial with the axis of rotation of said output providing means;

fluidic actuator means, said actuator means including a piston and having a piston rod extending outwardly therefrom, said actuator means being integral with said housing means;

cam means, said cam means including a cam rotatably mounted on a pivot shaft, said cam having a curved reaction surface and engaging said output means peripheral gear teeth; and means supporting said cam means in said housing means for contact by the end of said actuator means piston rod, linear motion of said piston rod in a first direction causing displacement of said cam means whereby rotation in a first direction is imparted to said output providing means.

2. The apparatus of claim 1 wherein said housing means is machined to define a cylinder in which the piston of said actuator means moves.

3. The apparatus of claims 1 or 2 wherein said cam means supporting means comprises:

lever arm means, said cam means pivot shaft being engaged by said lever arm means adjacent a first end thereof at either side of said cam, said lever arm means being rotatably coupled to said output means adjacent the second end of said lever arm means.

4. The apparatus of claims 1 or 2 wherein said cam means supporting means comprises:

an arcuate guide slot in said housing means; and bearing means supporting said cam means pivot shaft for movement along said guide slot.

5. The apparatus of claim 1 further comprising:

extension drive means, said extension drive means including;

a body;

an output member rotatably mounted on said body, said output member having gear teeth about its periphery and having a hole of other than circular shape in at least one end thereof, said hole being coaxial with the axis of rotation of said output member; and means for removably attaching said body to said housing means with the peripheral teeth of said output means in engagement with the peripheral teeth of said extension drive means output member.

6. The apparatus of claim 5 wherein said attaching means comprises:

at least a pair of spacially displaced locating pin means extending outwardly from said body; and a plurality of locating pin means receiving holes in said housing means, said housing means pin receiving holes being spaced to simultaneously receive at least a pair of said locating pin means, said housing means locating pin receiving holes being greater in number than said locating pin means whereby said extension drive means may assume a plurality of different orientations on said housing means.

7. The apparatus of claim 6 wherein said cam means supporting means comprises:

lever arm means, said cam means pivot shaft being engaged by said lever arm means adjacent a first end thereof at either side of said cam, said lever arm means being rotatably coupled to said output means adjacent the second end of said lever arm means.

8. The apparatus of claim 6 wherein said cam means supporting means comprises:

an arcuate guide slot in said housing means; and bearing means supporting said cam means pivot shaft for movement along said guide slot.

9. The apparatus of claim 1, further comprising:

means for preventing rotation of said output providing means in a second direction opposite to said first direction during motion of said piston rod in a second direction.

10. The apparatus of claim 9 further comprising:

link means for coupling said cam means to said actuator means piston rod whereby said piston rod will push said cam means cam during movement of said actuator means piston in the first direction and will pull said cam means via said link means during movement of said piston in the second direction.

11. The apparatus of claim 10 wherein the motion of said actuator means piston in the first and second directions is caused by selectively delivering pressurized fluid to and venting fluid from said actuator means cylinder to either side of said piston means and wherein said housing means includes:

at least a pair of separate fluid supply passages formed in said housing means, said passages communicating between the exterior of said housing means and respective opposite ends of said actuator means cylinder.

12. The apparatus of claim 10 wherein motion of said actuator means piston in the first direction is caused by the delivery of pressurized fluid to said actuator means cylinder at a first side of said piston and wherein said apparatus further comprises:

a spring positioned in said actuator means cylinder and extending between said piston and a first end of said cylinder, said spring returning said actuator means piston to a position adjacent a first end of the cylinder upon termination of the delivery of pressurized fluid to said cylinder at the said first side of said piston.

13. The apparatus of claim 2 wherein said actuator means further comprises:

a cam follower insert affixed to the end of said piston rod, said insert being formed of a wear resistant material and having a smooth surface whereby said cam may easily rotate during displacement of said cam means under the influence of said actuator means.

14. The apparatus of claim 11 wherein said actuator means further comprises:

a cam follower insert affixed to the end of said piston rod, said insert being formed of a wear resistant material and having a smooth surface whereby said cam may easily rotate during displacement of said cam means under the influence of said actuator means.

15. The apparatus of claim 12 wherein said actuator means further comprises:

a cam follower insert affixed to the end of said piston rod, said insert being formed of a wear resistant material and having a smooth surface whereby said cam may easily rotate during displacement of said cam means under the influence of said actuator means.

* * * * *